US005440761A

United States Patent [19]

Abrams et al.

[11] Patent Number: 5,440,761

[45] Date of Patent: Aug. 15, 1995

[54] MULTI-FACETED PHOTOGRAPHER'S VEST

[75] Inventors: Jack Abrams, Commack; William Giordano, Huntington Bay, both of N.Y.

[73] Assignee: Nikon Inc., Melville, N.Y.

[21] Appl. No.: 11,213

[22] Filed: Jan. 29, 1993

[51] Int. Cl.[6] ..... A41D 1/04

[52] U.S. Cl. ..... 2/102; 2/94; 224/908; 224/215

[58] Field of Search ..... 2/94, 102, 48, 49.3, 2/51; 224/908, 909, 215

[56] References Cited

U.S. PATENT DOCUMENTS 4,091,974 5/1978 McClintock .
4,125,211 11/1978 Handsman .
4,158,490 6/1979 Gottschalk et al. .
4,272,852 6/1981 Bell .
4,273,216 6/1981 Weissmann .
4,298,149 11/1981 Gottschalk et al. .
4,564,957 1/1986 Scharf ..... 2/94
4,637,075 1/1987 Ingrisano et al. ..... 2/94
5,323,942 6/1994 Dahan ..... 224/908

*Primary Examiner*—Andrew M. Falik
*Assistant Examiner*—Gloria Hale
*Attorney, Agent, or Firm*—Klauber & Jackson

[57] ABSTRACT

A multi-faceted photographer's vest (10) includes a half of a typical camera strap (12) extending from the right shoulder area, and a half of a typical camera strap (14) extending from the left shoulder area. Each camera strap half (12),(14) has a material end (16),(18) that is sewn or stitched to the vest (10) in the right and left shoulder areas, respectively, so that they are permanently and securely attached thereto. Each camera strap half (12),(14) also has a free end (20),(22) that lays approximately mid-torso, on the right and left sides, respectively, of a vest wearer (24). The free end (20),(22) of each camera strap half (12),(14) is attached to a camera (42) in a typical manner. The vest (10) also provides several pockets and compartments (44),(62) for storing photography related accessories and other items.

24 Claims, 6 Drawing Sheets

MULTI-FACETED PHOTOGRAPHER'S VEST

BACKGROUND OF THE INVENTION

1. Field of the Invention

The present invention relates to garments having permanently affixed article carrying means and, more particularly, to a vest specifically designed to permit a wearer to conveniently and comfortably carry cameras, camera acoessories, and other photography related articles.

2. Description of the Prior Art

Garments providing permanent means for carrying or securing various articles are generally known within a respective variety of arts. For example, U.S. Pat. Nos. 4,272,852 and 4,273,216 each disclose garments that provide straps which are permanently sewn or stitched thereto. In U.S. Pat. No. 4,272,852, the straps are used for removably securing a knapsack to either the front or the rear of the garment. In U.S. Pat. 4,273,216, the straps are used for securing a line to the garment for purposes of safety. It is clear that both of these garments were specifically designed for the purpose of performing their respective particular functions.

Within the arts of photography and cinematography, those closest to that of the present invention, it is generally known to provide a strap or harness for carrying or supporting a camera, camera accessories, and other photography related articles. For example, U.S. Pat. Nos. 4,091,974, 4,125,211, 4,298,149, and 4,158,490 all address various methods of employing a strap or harness for carrying or supporting a camera. A brief description of these prior art methods is now given.

In U.S. Pat. No. 4,091,974, a camera harness is disclosed that includes a collar strap which extends over the shoulders of a user, and an elastic band that is threaded through slots in the collar strap so as to be arrangeable under the armpits of the user and to be fastenably joined by its ends on the back of the user. Such a harness seeks to spread the weight associated with carrying one or more cameras that are attached to the harness across the user's shoulders and back, thereby relieving neck strain that is commonly incurred when one or more single camera straps are used.

In U.S. Pat. No. 4,125,211, a camera strap is disclosed which is capable of carrying multiple camera units. The camera strap includes two shoulder portions whose front ends extend over the shoulders of a user so as to allow the multiple camera units to be attached thereto, and whose rear ends converge toward one another on the back of the user. The camera strap also includes an elastic back portion which has its upper end connected to the two shoulder portions where they converge, and its lower end attached to the user's pants or belt. The elastic back portion keeps the camera strap below the neck of the user, which acts to prevent neck strain that commonly occurs when one or more single camera straps are used.

In U.S. Pat. No. 4,298,149, a body harness is disclosed that is specifically designed to be used by a motion picture or a television Cameraman. The body harness provides support for a single motion picture or television camera and its associated components, and is beneficial in that it distributes the weight of such an apparatus on the hips and shoulders of a user.

Lastly, in U.S. Pat. No. 4,158,490, a body harness similar to the one described immediately above is disclosed. This body harness also seeks to distribute the weight of a motion picture or television camera on the hips and shoulders of a user.

Although all of the above-mentioned prior art methods provide certain desired benefits in the context of carrying or supporting one or more cameras, particularly with respect to stress and strain on a user's body, none provide any storage capability for accessories that are commonly used with cameras or photographic equipment in general, such as extra lenses, spare film, and the like. Furthermore, the above-described garments, besides also lacking storage capabilities for accessories, are described as having a full upper body length. Such full length garments often lack the mobility that is required for certain photographic events. It is therefore desirable to overcome the shortcomings of the above-mentioned prior art, while providing a convenient and practical means for carrying cameras, camera accessories, and other photography related articles.

SUMMARY OF THE INVENTION

The present invention contemplates a photographer's vest that is specifically designed to permit a wearer to conveniently and comfortably carry cameras, camera accessories, and other photography related articles. Such a vest is constructed from a standard photographer's or fisherman's vest having a plurality of pockets and compartments for accessory storage. The vest typically has a half upper body length so as to provide a wearer with essentially unrestricted mobility, which is often required for certain photographic events. The vest may be fabricated from a variety of materials, although materials that are waterproof or made to be water and/or soil resistant are generally preferred.

On the front of the vest just below the right shoulder area there is attached a material end of a half of a typical camera strap. Also, on the front of the vest just below the left shoulder area there is attached a material end of a half of a typical camera strap. The material end of each camera strap half is sewn or stitched to the vest so that they are permanently and securely attached thereto. Furthermore, each camera strap half extends down over the chest area of the vest, whereby a free end of each camera strap half lays approximately mid-torso with respect to the vest wearer. The free end of each camera strap half is attached to a camera in the typical manner.

The construction of the present invention photographer's vest acts to spread the weight associated with carrying the camera across the wearer's shoulders and back, thereby relieving neck strain. Also, the present invention vest provides numerous pockets and compartments for accessory storage. It should be noted that additional camera strap halves may be similarly attached to the vest to allow a second or even a third camera to be conveniently and comfortably carried.

From the above descriptive summary it is thus apparent how the present invention photographer's vest overcomes the shortcomings of the above-mentioned prior art.

Accordingly, the primary objective of the present invention is to provide a convenient, comfortable, and practical means for carrying cameras, camera accessories, and other photography related articles.

Other objectives and advantages of the present invention will become apparent to those skilled in the art upon reading the following detailed description and claims, in conjunction with the accompanying drawings which are appended hereto.

BRIEF DESCRIPTION OF THE DRAWINGS

In order to facilitate a fuller understanding of the present invention, reference is now be made to the appended drawings. The drawings should not be construed as limiting the present invention, but are intended to be exemplary only.

PREFERRED EMBODIMENTS OF THE PRESENT INVENTION

Figure 1:
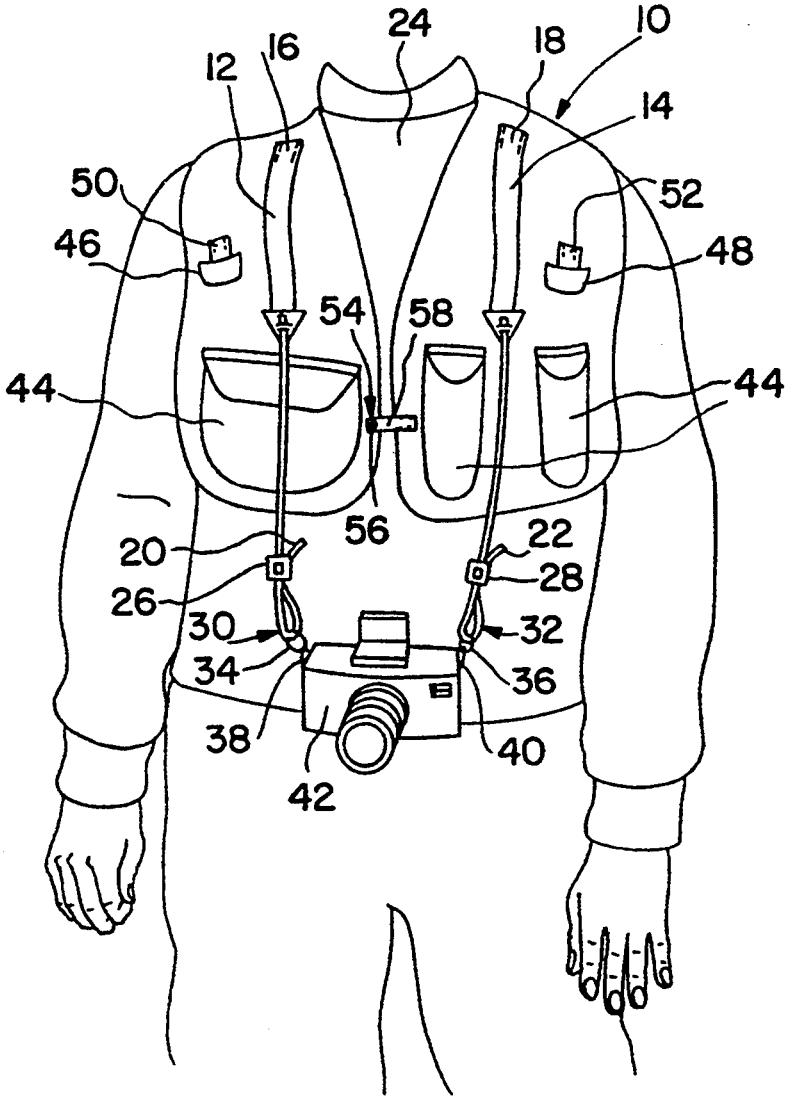
FIG. 1 is a front view of a present invention photographer's vest having straps for carrying a single camera.

Referring to FIG. 1, there is shown a front view of a present invention photographer's vest 10 having a half of a typical camera strap 12 extending from the right shoulder area, and a half of a typical camera strap 14 extending from the left Shoulder area. Each camera strap half 12,14 has a material end 16,18 that is sewn or stitched to the vest 10 in the right and left shoulder areas, respectively, so that they are permanently and securely attached thereto. Each camera strap half 12,14 also has a free end 20,22 that lays approximately mid-torso on a right and left side, respectively, of a vest wearer 24.

The free end 20,22 of each camera strap half 12,14 is engaged with a strap length adjuster 26,28, whereby a loop 30,32 is formed with the free end 20,22 of each camera strap 12,14. Each loop 30,32 secures a spiral ring 34,36 that mates with a carrying loop 38,40 on a camera 42. Such mating between the carrying loops 38,40 and the spiral rings 34,36, or between the camera 42 and the camera strap halves 12,14, in general, are common in the photographic arts.

The photographer's vest 10 is shown with several pockets or compartments 44 for storing accessories such as extra lenses, spare film, and Other photography related items. The pockets or compartments 44 can be made specifically for holding certain items or they can be made in general sizes. Also shown in FIG. 1 are two D-shaped rings 46,48. These rings 46,48 are secured to the vest 10 by way of two material loops 50,52, which are sewn or stitched to the vest 10 in a manner similar to the camera strap halves 12,14. The D-shaped rings 46,48 can be used to carry any frequently used camera accessories.

The photographer's vest 10 is further shown with a snap fastener 54 that is used to secure the vest 10 to the wearer 24. The snap fastener 54 is comprised of a male component (not shown) and a female component 56 that mate together when they are aligned and pressure is applied thereto. The female component 56 is attached to a piece of material 58, which is itself attached to the left side of the vest 10. The piece of material 58 is sewn or stitched to the vest 10 in a manner similar to the camera strap halves 12,14. The male component is attached to the right side of the vest 10 and, when mated with the female component 56 (as shown in FIG. 1), is positioned under the female component 56. It should be noted that there are many alternative means of securing the vest 10 to the wearer 24, such as a zipper or buttons. These alternative means are generally known within the art and are not critical to understanding the concept of the present invention.

Figure 2:
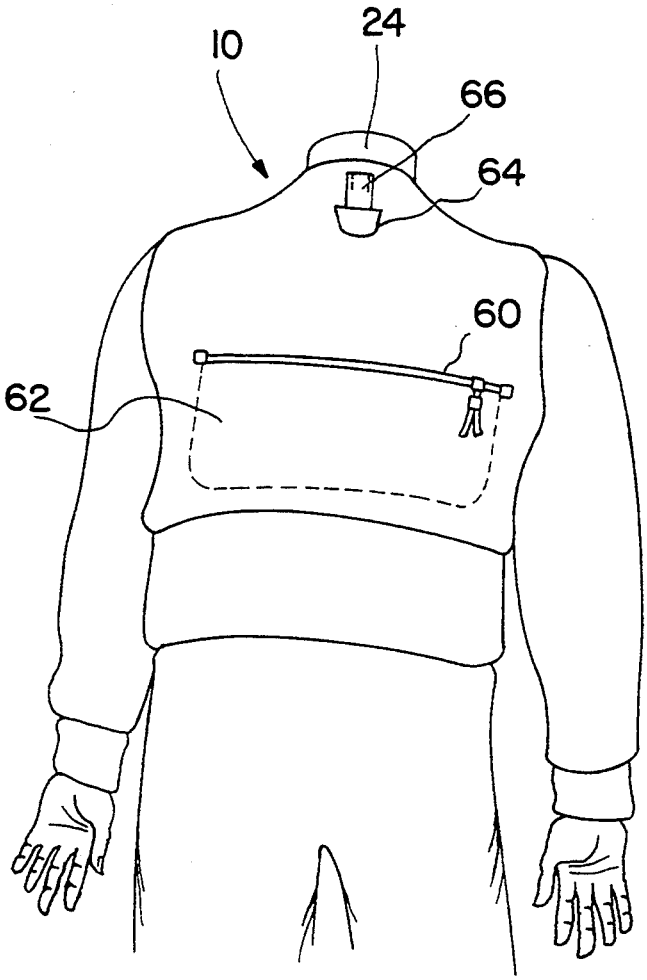
FIG. 2 is a rear view of the present invention photographer's vest shown in FIG. 1.

Referring to FIG. 2, there is shown a rear view of the present invention photographer's vest 10 with a zipper 60 extending across its width. When the zipper 60 disengaged (open), access is allowed to a large compartment 62 within the vest 10. This large compartment 62 can be used to store a variety of photography accessories and other items, although it is usually used to store such accessories and items that are not frequently required by the wearer 24 due to the awkward location of the compartment 62 with respect to the wearer 24. Also shown in FIG. 2 is a D-shaped ring 64. This ring 64 is secured to the vest 10 by way of a material loop 66, which is sewn or stitched to the vest 10 in a manner similar to the camera strap halves 12,14. The D-shaped ring 64 can be used to carry any number of camera accessories or other items, although, like the rear compartment 62, such accessories and items are those not frequently required by the wearer 24 due to the awkward location of the ring 64. It should be noted that the D-shaped ring 64 can also be used to hang the vest 10 when it is not being used.

Figure 4:
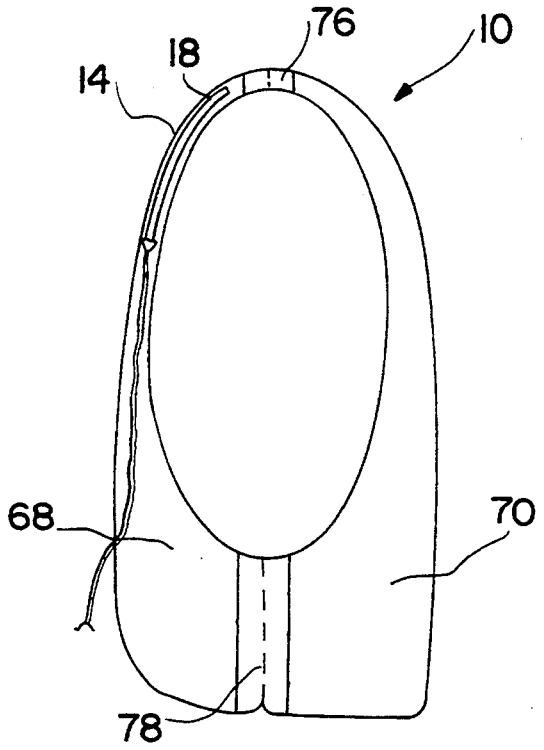
FIG. 4 is a left side view of the present invention photographer's vest shown in FIG. 1.
Figure 3:
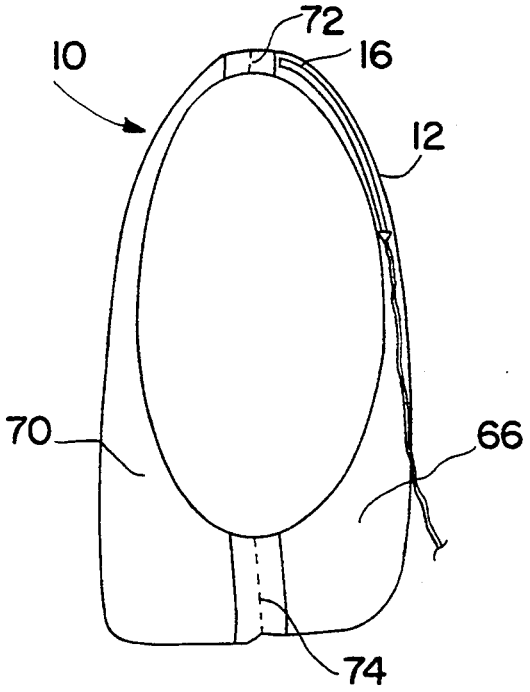
FIG. 3 is a right side view of the present invention photographer's vest shown in FIG. 1.

Referring to FIGS. 3 and 4, there is shown a right side view and a left side view of the photographer's vest 10, respectively, with the pockets and compartments 44 and the D-shaped rings 46,48 and the material loops 50,52 removed for figure clarity. These views are shown to illustrate how the vest 10 is most conveniently constructed. As shown there is a right front material section 66, a left front material section 68, and a rear material section 70. The right front material section 66 is attached to the rear material section 70 by sewing or stitching along a seam 72 and along a seam 74. The left front material section 68 is attached to the rear material section 70 by sewing or stitching along a seam 76 and along a seam 78. It should be noted that the camera strap halves 12,14 can be attached either at the seams 72,76, as shown, or just below the seams 72,76 on the front material sections 66,68, respectively.

Figure 5:
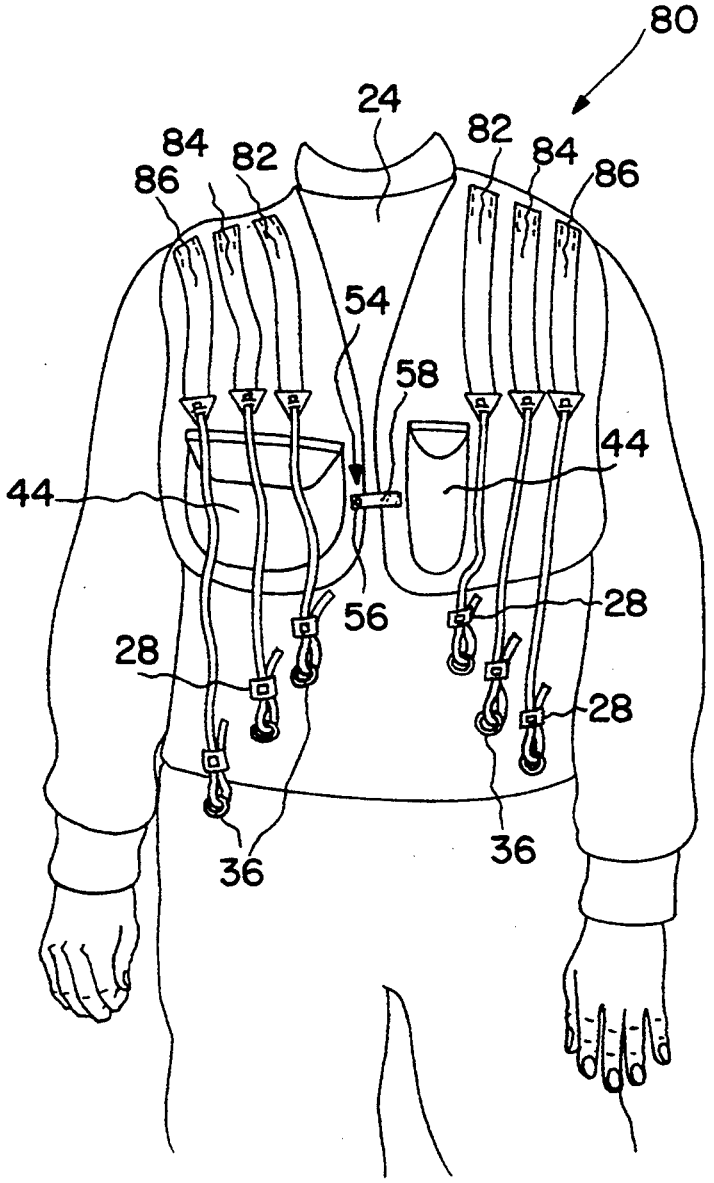
FIG. 5 is a front view of a present invention photographer's vest having straps for carrying three cameras.

Referring to FIG. 5, there is shown a front view of a present invention photographer's vest 80 having an alternate embodiment to that of the vest 10 shown in FIG. 1. This photographer's vest 80 has several pairs of camera strap halves 82,84,86 extending from the right and left shoulder areas. Such an embodiment is desirable if a wearer 88 needs to carry several cameras. The positioning of the pairs of camera strap halves 82,84,86 are shown to be offset down the front of the vest 80. However, the pairs of camera strap halves 82,84,86 may be overlapped, or a single pair of camera strap halves yielding three pairs of free ends may be alternatively employed. Other aspects of the photographer's vest 80 shown in FIG. 5 are similar to those shown in FIG. 1, and therefore are numerically identified as such. It should be noted, however, that although three pairs of camera strap halves 82,84,86 have been shown in FIG. 5, any reasonable number may be alternatively employed.

Figure 6:
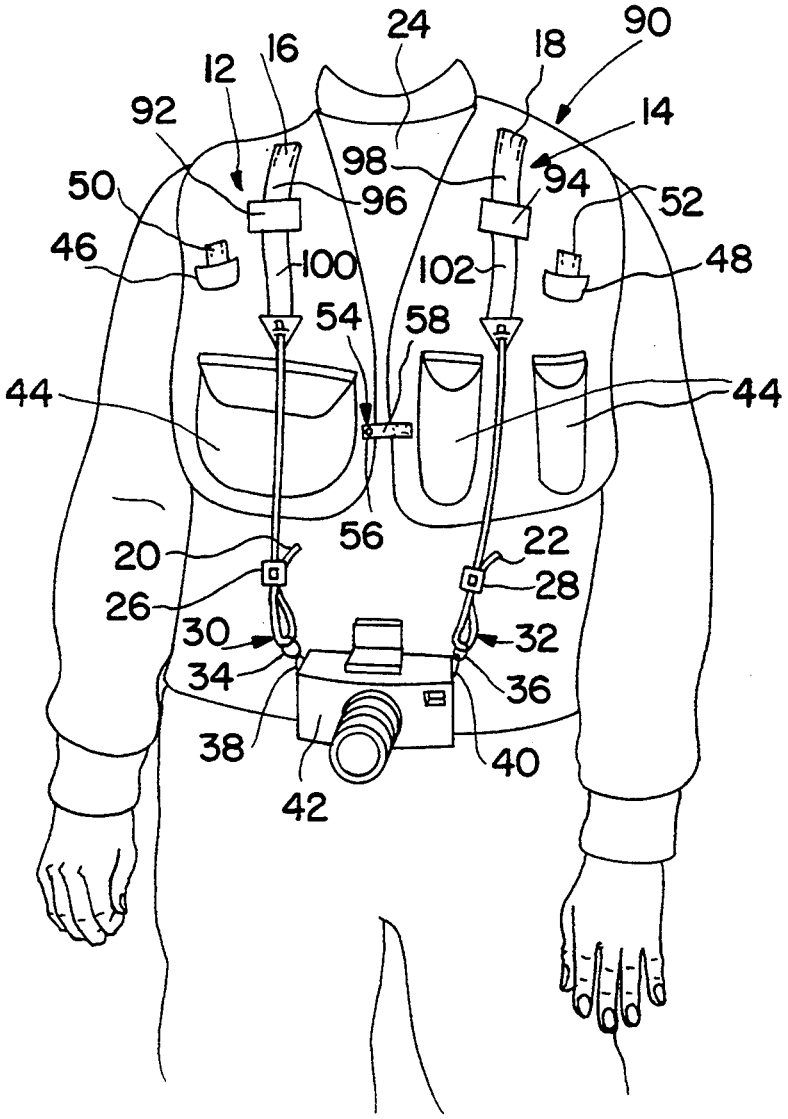
FIG. 6 is a front view of a present invention photographer's vest having straps with quick release buckles for forming a conventional camera strap.
Figure 7:
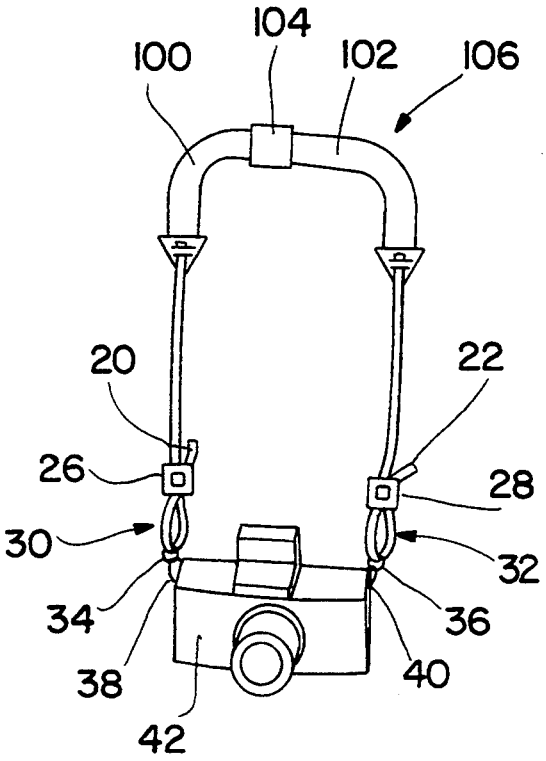
FIG. 7 shows a conventional camera strap formed from the straps of the photographer's vest shown in FIG. 6.

Referring to FIG. 6, there is shown a front view of a present invention photographer's vest 90 having an alternate embodiment to that of the vests 10,80 shown in FIGS. 1 and 5. This photographer's vest 90 provides quick release buckles 92,94 along the camera strap halves 12,14, respectively, thereby connecting upper 96,98 and lower 100,102 portions of the camera strap halves 12,14, respectively. Both quick release buckles 92,94 are comprised of male and female components which snap together to form the entire camera strap halves 12,14, respectively. The orientation of the quick release buckles 92,94 are reversed with respect to each other such that one of the lower portions 100,102 of the camera strap halves 12,14 has a male component while the other has a female component, and one of the upper portions 96,98 of the camera strap halves 12,14 has a female component while the other has a male component, respectively. Thus, when the quick release buckles 92,94 are unsnapped, a quick release buckle 104 comprised of the male and female components from the lower portions 100,102 of the camera strap halves 12,14 may be created, as shown in FIG. 7. By snapping together the male and female components from the lower portions 100,102 of the camera strap halves 12,14, a conventional camera strap 106 is formed with the quick release buckle 104 at its center. This embodiment of the present invention photographer's vest 90 provides a user the benefit of practical versatility with respect to the carrying of cameras. It should be noted that the other aspects of the photographer's vest 90 shown in FIGS. 6 and 7 are similar to those shown in FIG. 1, and therefore are numerically identified as such.

The photographer's vests 10,80,90 shown and described above may be fabricated from a variety of materials or blends of materials. Furthermore, the material of these vests 10,80,90 may be waterproof or made to be water and/or soil resistant for outdoor use. Since most photographer's vests are used both indoors and outdoors, vest materials that are waterproof or made to be water and/or soil resistant are generally preferred.

With the present invention photographer's vests 10,80,90 now fully described it can thus be seen that the primary objective set forth above is efficiently attained and, since certain changes may be made in the above described vests 10,80,90 without departing from the scope of the invention, it is intended that all matter contained in the above description or shown in the accompanying drawings shall be interpreted as illustrative and not in a limiting sense.

What is claimed is:

1. A multi-faceted photographer's vest comprising, in combination:

a sleeveless vest garment having a half upper body length for providing a wearer thereof with essentially unrestricted mobility, said vest garment comprising a right front section, a left front section, and a rear section, said right front section being attached to said rear section along a right shoulder seam and a right side seam, said left front section being attached to said rear section along a left shoulder seam and a left side seam, said right front section and said left front section being fastenable to each other by first fastening means; and a pair of camera strap halves, said pair of camera strap halves comprising a camera strap half corresponding to said right front section of said vest garment and a camera strap half corresponding to said left front section of said vest garment, wherein each said camera strap half in said pair is provided with a material end and a free end, wherein the material end of said right front section camera strap half is securely attached to said vest garment in the area of said right shoulder seam, wherein the material end of said left front section camera strap half is securely attached to said vest garment in the area of said left shoulder seam, and wherein the free end of each said camera strap half in said pair is provided with attachment means for removably attaching a carrying loop of a camera thereto, such that a camera may be removably attached to and suspended from and below said vest garment and said vest garment spreads the weight of such a camera across the shoulders and back of a wearer thereof, thereby relieving neck strain.

2. The multi-faceted photographer's vest as defined in claim 1, wherein said right front section camera strap half is securely attached to said vest garment by sewing or stitching said right front section camera strap half to said right front section of said vest garment, and wherein said left front section camera strap half is securely attached to said vest garment by sewing or stitching said left front section camera strap half to said left front section of said vest garment.

3. The multi-faceted photographer's vest as defined in claim 1, wherein the length of each said camera strap half is adjustable.

4. The multi-faceted photographer's vest as defined in claim 1, further comprising a plurality of accessory attaching means secured to said vest garment.

5. The multi-faceted photographer's vest as defined in claim 4, wherein said plurality of accessory attaching means are a plurality of D-shaped rings, wherein said plurality of D-shaped rings are secured to said vest garment by a like plurality of material loops, and wherein said like plurality of material loops are attached to said vest garment by sewing or stitching said material loops to said vest garment.

6. The multi-faceted photographer's vest as defined in claim 1, wherein said vest garment is fabricated from a material that is waterproof.

7. The multi-faceted photographer's vest as defined in claim 1, wherein said vest garment is fabricated from a material that is made to be water resistant.

8. The multi-faceted photographer's vest as defined in claim 1, wherein said vest garment is fabricated from a material that is made to be soil resistant.

9. The multi-faceted photographer's vest as defined in claim 1, wherein each said camera strap half in said pair comprises an upper portion associated with said material end and a lower portion associated with said free end, and wherein said upper portion and said lower portion are joined together by second fastening means.

10. The multi-faceted photographer's vest as defined in claim 9, wherein said fastening means comprises a male component and a female component which are fastenably engageable with each other, wherein said male and female components are individually secured to said upper and lower camera strap half portions such that said upper and lower portions are joined together when said male and female components are fastenably engaged with each other, and wherein the orientation of said male and female components are reversed between said right front section camera strap half and said left front section camera strap half such that said lower portions may be joined together so as to form a conventional camera strap.

11. The multi-faceted photographer's vest as defined in claim 1, wherein said vest garment is provided with a plurality of pockets and compartments for carrying photography related accessories and other various items.

12. A multi-faceted photographer's vest comprising, in combination:

a sleeveless vest garment having a half upper body length for providing a wearer thereof with essentially unrestricted mobility, said vest garment comprising a right front section, a left front section, and a rear section, said right front section being attached to said rear section along a right shoulder seam and a right side seam, said left front section being attached to said rear section along a left shoulder seam and a left side seam, said right front section and said left front section being fastenable to each other by first fastening means; and a plurality of pairs of camera strap halves, wherein each said pair of camera strap halves comprises a camera strap half corresponding to said right front section of said vest garment and a camera strap half corresponding to said left front section of said vest garment, wherein each said camera strap half in said plurality of pairs is provided with a material end and a free end, wherein the material end of each said right front section camera strap half is securely attached to said vest garment in the area of said right shoulder seam, wherein the material end of each said left front section camera strap half is securely attached to said vest garment in the area of said left shoulder seam, and wherein the free end of each said camera strap half in said plurality of pairs is provided with attachment means for removably attaching a carrying loop of a camera thereto, such that a plurality of cameras may be removably attached to and suspended from and below said vest garment and said vest garment spreads the weight of such a plurality of cameras across the shoulders and back of a wearer thereof, thereby relieving neck strain.

13. The multi-faceted photographer's vest as defined in claim 12, wherein each said right front section camera strap half is securely attached to said vest garment by sewing or stitching each said right front section camera strap half to said right front section of said vest garment, and wherein each said left front section camera strap half is securely attached to said vest garment by sewing or stitching each said left front section camera strap half to said left front section of said vest garment.

14. The multi-faceted photographer's vest as defined in claim 12, wherein the length of each said camera strap half is adjustable.

15. The multi-faceted photographer's vest as defined in claim 12, further comprising a plurality of accessory attaching means secured to said vest garment.

16. The multi-faceted photographer's vest as defined in claim 15, wherein said plurality of accessory attaching means are a plurality of D-shaped rings, wherein said plurality of D-shaped rings are secured to said vest garment by a like plurality of material loops, and wherein said like plurality of material loops are attached to said vest garment by sewing or stitching said material loops to said vest garment.

17. The multi-faceted photographer's vest as defined in claim 12, wherein said vest garment is fabricated from a material that is waterproof.

18. The multi-faceted photographer's vest as defined in claim 12, wherein said vest garment is fabricated from a material that is made to be water resistant.

19. The multi-faceted photographer's vest as defined in claim 12, wherein said vest garment is fabricated from a material that is made to be soil resistant.

20. The multi-faceted photographer's vest as defined in claim 12, wherein each said camera strap half in said plurality of pairs comprises an upper portion associated with said material end and a lower portion associated with said free end, and wherein said upper portion and said lower portion are joined together by second fastening means.

21. The multi-faceted photographer's vest as defined in claim 20, wherein said fastening means comprises a male component and a female component which are fastenably engageable with each other, wherein said male and female components are individually secured to said upper and lower camera strap half portions such that said upper and lower portions are joined together when said male and female components are fastenably engaged with each other, and wherein the orientation of said male and female components are reversed between said right front section camera strap halves and said left front section camera strap halves such that corresponding lower portions may be joined together so as to form a plurality of conventional camera straps.

22. The multi-faceted photographer's vest as defined in claim 12, wherein said vest garment is provided with a plurality of pockets and compartments for carrying photography related accessories and other various items.

23. The multi-faceted photographer's vest as defined in claim 1, wherein said right front section camera strap half is attached to said vest garment along said right shoulder seam, and wherein said left front section camera strap half is attached to said vest garment along said left shoulder seam.

24. The multi-faceted photographer's vest as defined in claim 12, wherein each said right front section camera strap half is attached to said vest garment along said right shoulder seam, and wherein each said left front section camera strap half is attached to said vest garment along said left shoulder seam.

* * * * *